US005956066A

United States Patent [19]

Suzuki

[11] Patent Number: 5,956,066

[45] Date of Patent: Sep. 21, 1999

[54] INK-TRANSFER-TYPE PRINTER

[75] Inventor: Minoru Suzuki, Tochigi-ken, Japan

[73] Assignee: Asahi Kogaku Kogyo Kabushiki Kaisha, Tokyo, Japan

[21] Appl. No.: 09/167,571

[22] Filed: Oct. 7, 1998

[30] Foreign Application Priority Data

Oct. 9, 1997 [JP] Japan ..... 9-293488

[51] Int. Cl.[6] ..... B41J 2/33; B41J 27/20; B41J 2/32; B41J 2/325

[52] U.S. Cl. ..... 347/171; 347/217

[58] Field of Search ..... 347/171, 217; 400/191, 192

[56] References Cited

U.S. PATENT DOCUMENTS

| | | | |
|---|---|---|---|
| 4,675,694 | 6/1987 | Bupara | 347/171 |
| 4,743,920 | 5/1988 | Tohma et al. | 347/171 |

FOREIGN PATENT DOCUMENTS

| | | |
|---|---|---|
| 0719994 | 7/1996 | European Pat. Off. . |
| 5305666 | 11/1993 | Japan . |
| 8-49960 | 2/1996 | Japan . |
| 10-799 | 1/1998 | Japan . |
| 10278217 | 10/1998 | Japan . |

OTHER PUBLICATIONS

An English Language abstract of JP 5–305666.
An English Language abstract of JP 8–49960.
WPI Abstract Accession No. 99–004033/01.

*Primary Examiner*—Huan Tran
*Attorney, Agent, or Firm*—Greenblum & Bernstein, P.L.C.

[57] ABSTRACT

An ink transfer type printer employs an ink holding member constituted by a porous body which contains ink therein and a film member made of a shape-memory resin which covers the porous body. The film member is provided with a plurality of through-holes. A film deforming member compresses the film member to collapse the through-holes and cools down the film member to the temperature lower than a glass transition temperature. A first heating member heats the selected parts of the deformed film member to the temperature higher than the glass transition temperature so as to restore the shape of the respective through-holes of the selected parts, and ink is transferred onto the recording sheet via the through-holes of the selected parts. Thereafter, a second heating member heats the overall parts of the deformed film member to the temperature higher than the glass transition temperature so as to totally restore the shape of the film member.

19 Claims, 2 Drawing Sheets

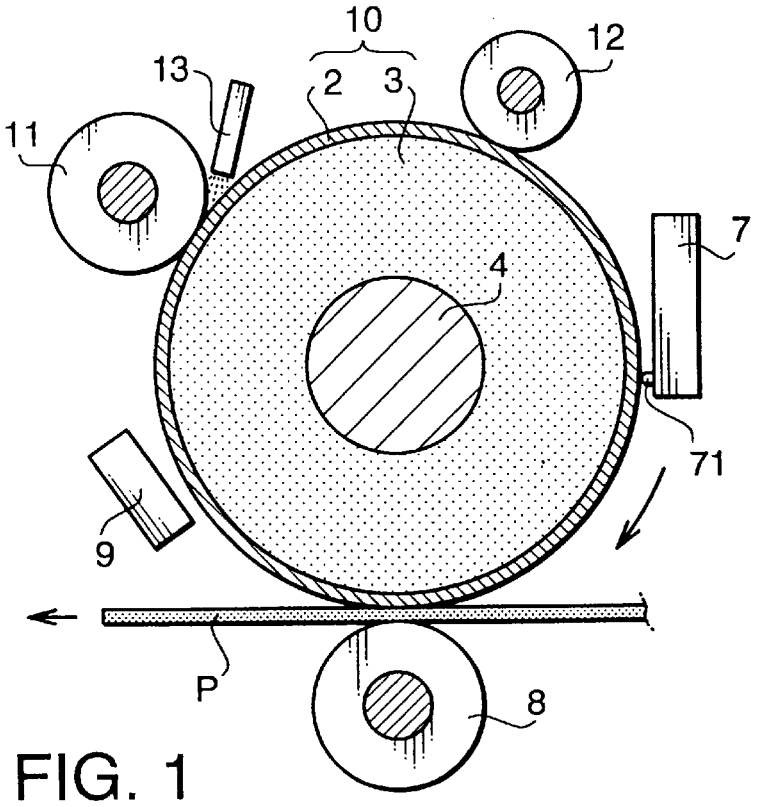
FIG. 1
FIG. 2
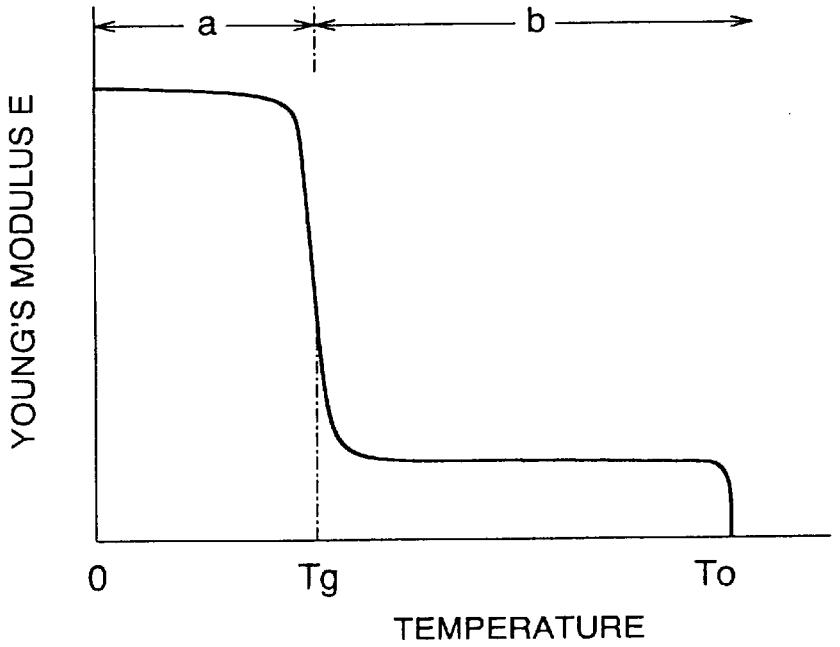

INK-TRANSFER-TYPE PRINTER

BACKGROUND OF THE INVENTION

The present invention relates to an ink-transfer-type printer which transfers ink to a recording sheet (such as a plain paper) to form an image thereon.

Among printers which transfer ink onto a recording sheet such as plain paper, the following printers are known: an ink jet printer that jets ink onto a recording sheet from nozzles as liquid droplets, a thermal transfer printer that heats an ink ribbon (which can be melted by heat) using a thermal head, thereby to transfer the ink onto a recording sheet; and a wire impact dot matrix printer that uses a steel wire for striking ink ribbons against a recording sheet.

However, these known printers have following problems: the ink jet printer may encounter clogging of ink in the nozzle; the thermal transfer printer may increase running cost due to the consumption of ink ribbons; and the wire dot printer is inferior in processing speed. Thus, a printer in which ink clogging is prevented, having a low running cost and a high processing speed has been desired.

In this connection, the present inventor has proposed an ink-transfer-type printer as disclosed in Japanese laid-open patent application No. Hei 10-799 published on Jan. 6, 1998. This printer comprises a ink roller constituted by covering a ink holding member with a film member which selectively allows the permeation of ink, and ink seeping out of the ink holding member through the film member is transferred onto a recording sheet. The film member is formed by uniformly dispersing additives in a matrix, the thermal expansion coefficient of which is larger than that of the additives.

Accordingly, when the film member is heated, the gap is formed around the respective additives due to the difference of the thermal expansion coefficients between the matrix and the additives. Thus, by heating the selected portions of the film member by means of a thermal head or the like, ink is able to seep out through the gaps formed at the heated portions, to be transferred onto a recording sheet to form a corresponding ink image thereon.

In the above ink-transfer-type printer, however, it is not easy to precisely control the operations of the printer, particularly to control the timing between heating the film member to form gaps in the film member and transferring the ink to the recording sheet.

SUMMARY OF THE INVENTION

It is therefore an object of the present invention to provide the improved ink-transfer-type printer whose printing operation is easily controllable.

For the above purpose, in accordance with the present invention, there is provided an ink-transfer-type printer which comprises:

an ink holding member constituted by a porous body which contains ink therein and a film member made of a shape-memory resin which covers the porous body, the film member being provided with a plurality of through-holes which allow passing of ink therethrough, at least said film member being circulated along a predetermined path;

a film deforming member which compresses the film member to collapse the through-holes and cools down the film member to the temperature lower than a glass transition temperature thereof;

a first heating member which heats the selected parts of the deformed film member to the temperature higher than the glass transition temperature so as to restore the shape of the respective through-holes of the selected parts; and a second heating member which heats the overall parts of the deformed film member to the temperature higher than the glass transition temperature so as to restore the shape of the through-holes thereof.

In the above printer, ink contained in the porous roller body is transferred to the recording sheet via the through-holes of the selected parts between the first heating member and the second heating member.

That is, the film member made of a shape-memory resin wherein the through-holes are formed as the given shape thereof is employed to cover the porous body which contains ink therein. When the temperature of the film member is higher than the glass transition temperature of the shape-memory resin, it shows the rubber elasticity so that the shape of the film member can be arbitrarily changed by applying pressure thereto, and the changed shape can be maintained if it is cooled down to the temperature lower than the glass transition temperature with keeping the pressure applied. Then, when the film member is again heated to the temperature higher than the glass transition temperature, the film member restores its given shape, although its shape can be arbitrarily changed as described above by applying pressure.

Accordingly, by collapsing the through-holes of the film member first and then restoring the given shape of the film member at its selected parts to allow the transfer of ink via the through-holes of the selected parts, the desired ink image can be formed on the recording sheet.

It is preferable to form the through-holes to be inclined with respect to the width direction of the film member. The through-holes can be surely collapsed when the film member is compressed.

The ink holding member may comprise an ink roller and the porous body may comprise a porous roller body, wherein the film member overlays the circumferential surface of the porous roller body. In this case, the film deforming member, the first heating member and the second heating member are to be disposed along the ink roller in this order in the direction of rotation of the ink roller.

Optionally, the first heating member may comprise a thermal line head disposed in the axial direction of the ink roller, and the film deforming member may comprise a press roller and a cooling fan. The press roller and the cooling fan are to be arranged successively along the circumferential surface of the ink roller in the rotary direction thereof to immediately cool down the compressed film member.

The printer may further comprise a platen roller and a cleaning member. The platen roller is to be disposed to face the circumferential surface of the ink roller, between the first and second heating members, so as to nip the recording sheet therebetween. The cleaning member is to remove the ink remaining on the surface of the ink roller after ink is transferred onto the recording sheet.

In the embodiment, a shape-memory resin comprises a polyurethane resin.

In accordance with the other aspect of the invention, there is provided a printing process for forming an ink image on a recording sheet by employing an ink holding member constituted by a porous body which contains ink therein and a film member made of a shape-memory resin which covers the porous body, the film member being provided with a plurality of through-holes which allow passing of ink therethrough, at least the film member being circulated along a predetermined path, the process comprising:

deforming the film member by compressing the film member to collapse the through-holes and cooling down the film member to the temperature lower than a glass transition temperature thereof;

heating the selected parts of the deformed film member, in accordance with an image to be formed, to the temperature higher than the glass transition temperature so as to restore the shape of the respective through-holes of the selected parts;

transferring ink to the recording sheet via the through-holes of the selected parts; and heating the overall parts of the deformed film member to the temperature higher than the glass transition temperature so as to restore the shape of the through-holes of the overall parts thereof.

Preferably, heating the selected parts may be performed by means of a thermal line head disposed to extend in the direction perpendicular to the feeding direction of the recording sheet.

Further, it is desirable to clean the surface of the ink roller to remove the ink remaining on the surface of the ink roller after ink is transferred to the recording sheet.

According to still other aspect of the invention, there is provided an ink holding member adapted for use in an ink-transfer-type printer which comprises a porous body which contains ink therein and a film member made of a shape-memory resin which covers the porous body. The film member is provided with a plurality of through-holes, as the given shape, which allow passing of ink therethrough.

The through-holes are preferably formed to be inclined with respect to the direction of the thickness of the film member, and the shape-memory resin may comprise a polyurethane resin.

BRIEF DESCRIPTION OF THE DRAWINGS

FIG. 1 is a sectional view showing a principal constitution of an ink-transfer-type printer embodying the invention;

FIG. 2 is a graph showing the relationship between the temperature and the elasticity of shape-memory resin.

DESCRIPTION OF THE PREFERRED EMBODIMENTS

An ink-transfer-type printer embodying the invention will be described hereafter by referring to the accompanying drawings.

FIG. 1 is a side sectional view showing a principal constitution of the ink-transfer-type printer embodying the invention.

The shown printer comprises an ink roller 10 which is constituted by a porous roller body 3 made of a porous ceramic which contains ink therein and a film member 2 made of a shape-memory resin which overlays the circumferential surface of the porous roller body 3.

Figure 3A:
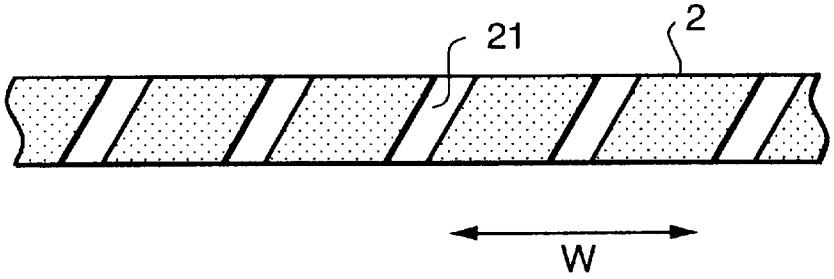
FIGS. 3A through 3D show the changes of the shape of a film member during printing process.

The shape-memory resin shows such a relationship between the temperature and the Young's modulus thereof as, for instance, shown in FIG. 2. The shape memory resin exhibits rubber elasticity above the glass transition temperature Tg due to micro-Brownian motion of molecular chains (region b), whereas it exhibits the glassy state below the glass transition temperature Tg due to the freezing of micro-Brownian motion (region a). The film member made of the shape-memory resin is once heated to the temperature higher than a shape providing temperature To, where such a plurality of inclined through-holes as illustrated in FIG. 3A are formed as a given shape. Then, the film member thus made of the shape-memory resin can be arbitrarily deformed between the glass transition temperature Tg and the shape providing temperature To, and the deformed shape can be fixed by cooling it below Tg while keeping deformed state. However, the film member thus deformed recover its given shape by again heating it to Tg or higher.

The shape-memory resin having the glass transition temperature of 50° C. through 130° C. can be used in the printer of the present invention. However, by taking the power consumption and/or the unintentional seeping of ink into consideration, preferable range of the glass transition temperature is 50° C. Thorough 80° C., and in this embodiment, the range of the glass transition temperature Tg is set between 60° C. and 80° C.

Examples of the shape-memory resin are as follows: (1) polynorbornene, (2) trans-1, 4-polyisoprene, (3) polyurethane, and so on. In this embodiment, polyurethane resin, which is low cost and has excellent moldability, is used. The shape-memory resin is disclosed in Japanese Laid-Open Patent Application Nos. HEI 5-305666 and HEI 8-49960, the teachings of which are incorporated herein by reference in their entireties.

A plurality of through-holes 21, through which ink passes, are formed as the given shape in the film member 2. The through-holes 21 are, as illustrated in FIG. 3A and will be explained later in detail, inclined by a predetermined angle with respect to the direction of the thickness of the film member 2.

The ink-transfer-type printer operates as follows.

As shown in FIG. 1, the ink roller 10 is rotatably supported by an axial shaft 4 and rotated in a clockwise direction in figure by means of a driving mechanism, not shown. Along the outer circumferential surface of the ink roller 10, a thermal line head 7, a platen roller 8, a heater 9, a press roller 11, a cooling fan 13 and a cleaning roller 12 are arranged in this order in the rotary direction of the ink roller 10.

The thermal line head 7 comprises a plurality of heating members 71 arranged in the axial direction of the ink roller 10 for selectively heating the film member 2 in accordance with image data to raise the temperature of the corresponding portions of the film member 2 to more than the glass transition temperature Tg.

The platen roller 8 is disposed in parallel with the ink roller 10 and arranged to nip a recording sheet P therebetween. Upon rotation of the ink roller 10, the recording sheet P nipped between the ink roller 10 and the platen roller 8 is fed leftwardly in FIG. 1.

The heater 9 comprises a so-called sheath heater and heats the film member 2 overall in the axial direction of the ink roller 10 to the glass transition temperature Tg or the higher.

The press roller 11 is arranged to press the film member 2 against the porous roller body 3, and the cooling fan 13 is arranged to blow a cooling medium such as nitrogen gas to the pressed portion of the film member 2 to cool the film member 2 down to the temperature lower than the glass transition temperature Tg. Here it should be noted that ink remained in the through-holes 21 of the film member 2 is led out of the through-holes 21 at the time when the film member 2 is pressed by the press roller 11, some is led toward the porous roller member 3 and the other toward the outer surface of the film member 3, as the through-holes 21 are inclined with respect to the direction of pressing force applied by the press roller 11. Thus, the ink led out of the through-holes 21 exists on the upper surface of the film member 2 under the state illustrated in FIG. 3B.

The cleaning roller 12 contacts the circumferential surface of the ink roller 10 to remove the ink remaining on the surface of the film member 2.

FIGS. 3A through 3D illustrate the state transition of the through-holes of the film member 2. In these figures, the width direction W of the film member 2 coincides with the axial direction of the ink roller 10 (i.e., the direction of the arrangement of the heating members 71 of the thermal line head 7).

As illustrated in FIG. 3A, under the condition where the film member 2 is heated by the heater 9 to the temperature Tg or higher, the through-holes 21 of the film member 2 are open enough to allow ink to pass therethrough.

Figure 3B:
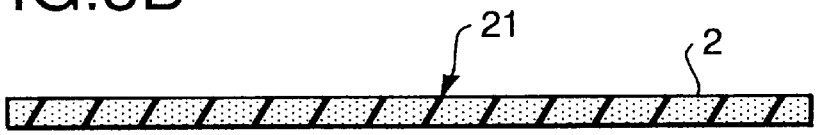

By pressing the film member 2 against the porous roller body 3 at the press roller 11 and cooling it down to the temperature lower than Tg by the cooling fan 13, the through-holes 21 are collapsed and kept closed as illustrated in FIG. 3B.

Figure 3C:
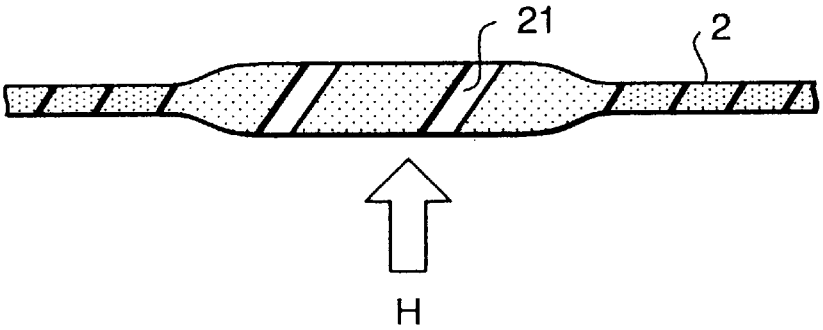

Then, by heating the selected part(s) of the film member 2 to the temperature Tg or higher by means of the thermal line head 7 in accordance with the image data, the selectively heated part(s) of the film member 2 return to the given shape, and the though-holes 21 therein are open as illustrated in FIG. 3C.

Under the condition illustrated in FIG. 3C, ink held in the porous roller body 3 can pass only through the opened through-holes 21. Here, it should be noted that the ink remaining on the film member 2 is removed at the cleaning roller 12 under the condition illustrated in FIG. 3B.

Then, at the platen roller 8, ink passed through the selectively opened through-holes 21 of the film member 2 is transferred onto the recording sheet P to form an ink image thereon.

Figure 3D:
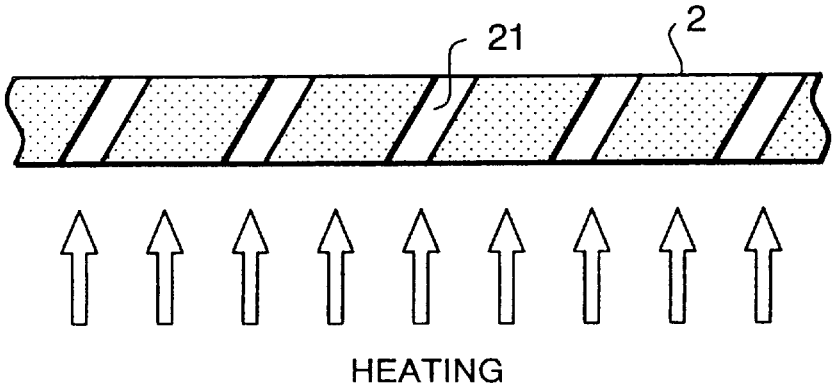

Thereafter, the film member 2 is heated overall in the axial direction of the ink roller 10, to restore the given state illustrated in FIG. 3D which is the same as in FIG. 3A. By cyclicaly performing the above processes, the ink image is formed on the recording sheet P in accordance with the image data.

With the above printer, until the heater 9 heats the film member 2 overall in the axial direction, only the through-holes 21 selectively heated by means of the thermal line head 7 are kept open. Accordingly, anywhere between the thermal line head 7 and the heater 9 can be chosen as the position to transfer ink from the ink roller 10 onto the recording sheet P without paticular attention to the control of timing.

The present disclosure relates to the subject matter contained in Japanese Patent Application No. Hei 09-293488 filed on Oct. 9, 1998, which is expressly incorporated herein by reference in its entirety.

What is claimed is:

1. An ink transfer type printer wherein ink is transferred onto a recording sheet to form an ink image thereon, said printer comprises:

an ink holding member constituted by a porous body which contains ink therein and a film member made of a shape-memory resin which covers said porous body, said film member being provided with a plurality of through-holes which allow passing of ink therethrough, at least said film member of said ink holding member being circulated along a predetermined path;

a film deforming member which compresses said film member to collapse said through-holes and cools down the film member to the temperature lower than a glass transition temperature thereof;

a first heating member which heats the selected parts of the deformed film member to the temperature higher than said glass transition temperature so as to restore the shape of the respective through-holes of said selected parts; and a second heating member which heats the overall parts of the deformed film member to the temperature higher than said glass transition temperature so as to restore the shape of the through-holes thereof, and, wherein ink contained in the porous roller body is transferred to the recording sheet via the through-holes of said selected parts between said first heating member and said second heating member.

2. The ink-transfer-type printer according to claim 1, wherein said through-holes are formed to be inclined with respect to the direction of the thickness of the film member.

3. The ink-transfer-type printer according to claim 1, wherein said ink holding member comprises an ink roller and said porous body comprises a porous roller body, wherein said film member overlays the circumferential surface of said porous roller body, and wherein said film deforming member, said first heating member and said second heating member are disposed along said ink roller in this order in the direction of rotation of said ink roller.

4. The ink-transfer-type printer according to claim 3, wherein said first heating member comprises a thermal line head disposed in the axial direction of said ink roller.

5. The ink-transfer-type printer according to claim 3, which further comprises a platen roller disposed to face the circumferential surface of said ink roller, between said first and second heating members, so as to nip the recording sheet therebetween.

6. The ink-transfer-type printer according to claim 3, wherein said film deforming member comprises a press roller and a cooling fan, said press roller and said cooling fan being arranged successively along the circumferential surface of said ink roller in the rotary direction thereof to immediately cool down the compressed film member.

7. The ink-transfer-type printer according to claim 1, which further comprises a cleaning member which removes the ink remaining on the surface of the ink roller after ink is transferred onto the recording sheet.

8. The ink-transfer-type printer according to claim 4, which further comprises a cleaning roller disposed just upstream of said thermal line head.

9. The ink-transfer-type printer according to claim 1, wherein said shape-memory resin comprises a polyurethane resin.

10. An ink holding member adapted for use in an ink-transfer-type printer, comprising:

a porous body which contains ink therein; and a film member made of a shape-memory resin which covers said porous body, said film member being provided with a plurality of through-holes which allow passing of ink therethrough.

11. The ink holding member according to claim 10, wherein said through-holes are formed to be inclined with respect to the direction of the thickness of the film member.

12. The ink holding member according to claim 10, wherein said porous body comprises a porous roller body and said film member overlays the circumferential surface of said porous roller body.

13. The ink holding member according to claim 10, wherein said shape-memory resin comprises a polyurethane resin.

14. A printing process for forming an ink image on a recording sheet by employing an ink holding member constituted by a porous body which contains ink therein and a film member made of a shape-memory resin which covers said porous body, said film member being provided with a plurality of through-holes which allow passing of ink therethrough, at least said film member of said ink holding member being circulated along a predetermined path, said process comprising:

deforming said film member by compressing said film member to collapse said through-holes and cooling down the film member to the temperature lower than a glass transition temperature thereof;

heating the selected parts of the deformed film member, in accordance with an image to be formed, to the temperature higher than said glass transition temperature so as to restore the shape of the respective through-holes of said selected parts;

transferring ink to the recording sheet via the through-holes of said selected parts; and heating the overall parts of the deformed film member to the temperature higher than said glass transition temperature so as to restore the shape of the through-holes of the overall parts thereof.

15. The printing process according to claim 14, wherein said first heating is performed by means of a thermal line head disposed to extend in the direction perpendicular to the circulating direction of said film member.

16. The printing process according to claim 14, which further comprises cleaning the surface of said film member to remove the ink remaining on the surface of the film member after ink is transferred to the recording sheet.

17. The ink-transfer-type printer according to claim 1, wherein the range of the glass transition temperature of said shape-memory resin is between 50° C. through 80° C.

18. The ink holding member according to claim 10, wherein the range of the glass transition temperature of said shape-memory resin is between 50° C. through 80° C.

19. The printing process according to claim 14, wherein the range of the glass transition temperature of said shape-memory resin is between 50° C. through 80° C.

* * * * *